US010653211B2

(12) United States Patent
Ressler

(10) Patent No.: US 10,653,211 B2
(45) **Date of Patent: *May 19, 2020**

(54) TENSION BUCKLE SYSTEM AND TWO-PART TENSION BUCKLE DEVICE

(71) Applicant: Dutch Clips LLC, Reinholds, PA (US)

(72) Inventor: Thomas Ressler, Reinholds, PA (US)

(73) Assignee: Dutch Clips LLC, Reinholds, PA (US)

( * ) Notice: Subject to any disclaimer, the term of this patent is extended or adjusted under 35 U.S.C. 154(b) by 369 days.

This patent is subject to a terminal disclaimer.

(21) Appl. No.: 15/261,164

(22) Filed: Sep. 9, 2016

(65) Prior Publication Data

US 2018/0070682 A1 Mar. 15, 2018

(51) Int. Cl.

| | |
|---|---|
| ***A44B 11/02*** | (2006.01) |
| ***A45F 3/24*** | (2006.01) |
| ***A45F 3/04*** | (2006.01) |
| *A45F 3/00* | (2006.01) |
| *E04H 15/32* | (2006.01) |

(52) U.S. Cl.

CPC ..... *A44B 11/02* (2013.01); *A45F 3/24* (2013.01); *A45F 2003/001* (2013.01); *E04H 15/322* (2013.01)

(58) Field of Classification Search

CPC ..... A44B 11/02; A45F 3/24; A45F 2003/001; A45F 3/04; E04H 15/322

See application file for complete search history.

(56) References Cited

U.S. PATENT DOCUMENTS

| | | | | |
|---|---|---|---|---|
| D56,993 | S | 1/1921 | Robinson | |
| 1,803,214 | A | 4/1931 | Siegel | |
| 2,142,645 | A * | 1/1939 | Hall | A41F 11/04 24/530 |
| 2,650,401 | A * | 9/1953 | La Mond | B60J 11/00 135/119 |
| D269,389 | S * | 6/1983 | Wood | D11/212 |
| 5,427,562 | A * | 6/1995 | Hwang | A41C 3/0028 2/73 |
| D418,449 | S * | 1/2000 | Lawrence, Jr. | D11/212 |
| D536,638 | S * | 2/2007 | Fildan | D11/210 |
| D687,347 | S | 8/2013 | Gillan | |
| 8,720,846 | B2 * | 5/2014 | Wohlford | H04N 5/64 248/499 |

(Continued)

FOREIGN PATENT DOCUMENTS

| | | | | |
|---|---|---|---|---|
| FR | 2563093 | A1 * | 10/1985 | A45C 15/00 |

*Primary Examiner* — Robert Sandy

*Assistant Examiner* — Louis A Mercado

(74) *Attorney, Agent, or Firm* — Barley Snyder

(57) ABSTRACT

A tension buckle is provided and includes a slider body and a toggle body. The slider body includes a head with a slider strap receiving passageway extending there through from lateral sides thereof and positioned along a proximal end thereof, and a distal end having a neck positioned opposite the proximal end and tie section extending from the neck. The toggle body includes a top bar, a bottom bar positioned substantially parallel to the top bar, a first joining element connecting a first end of the top bar and a first end of the bottom bar, and a second joining element connecting a second end of the top bar and a second end of the bottom bar to provide a toggle strap receiving passageway extending though the toggle body from lateral sides thereof and positioned offset from the slider strap receiving passageway.

23 Claims, 7 Drawing Sheets

(56) References Cited

U.S. PATENT DOCUMENTS

| | | | | |
|---|---|---|---|---|
| D739,302 | S | 9/2015 | Nilsen et al. | |
| D749,461 | S | 2/2016 | Wong | |
| 9,717,308 | B2 * | 8/2017 | Bowerman | A44B 11/02 |
| 2002/0148079 | A1 * | 10/2002 | Morris | B63B 17/02 24/265 R |
| 2004/0006853 | A1 * | 1/2004 | Yang | A41F 15/002 24/197 |
| 2013/0221052 | A1 * | 8/2013 | Shereyk | A45F 3/047 224/642 |
| 2016/0095406 | A1 * | 4/2016 | Bowerman | A44B 11/04 24/163 R |

* cited by examiner

FIG. 3
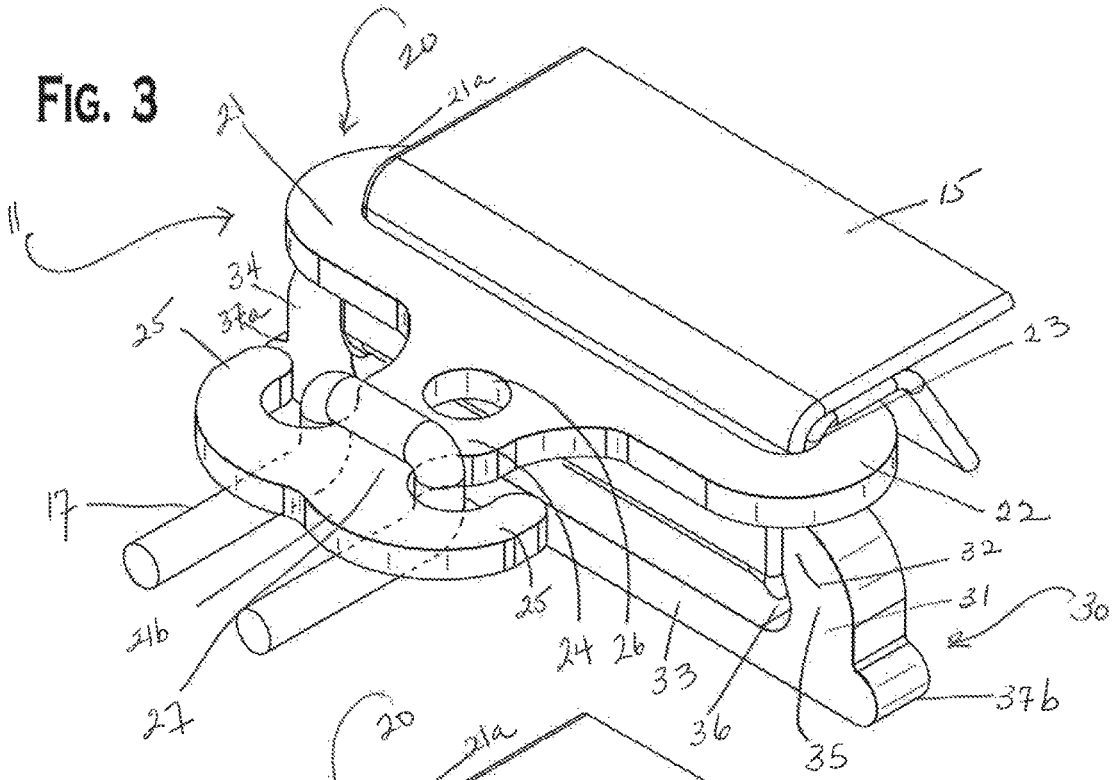
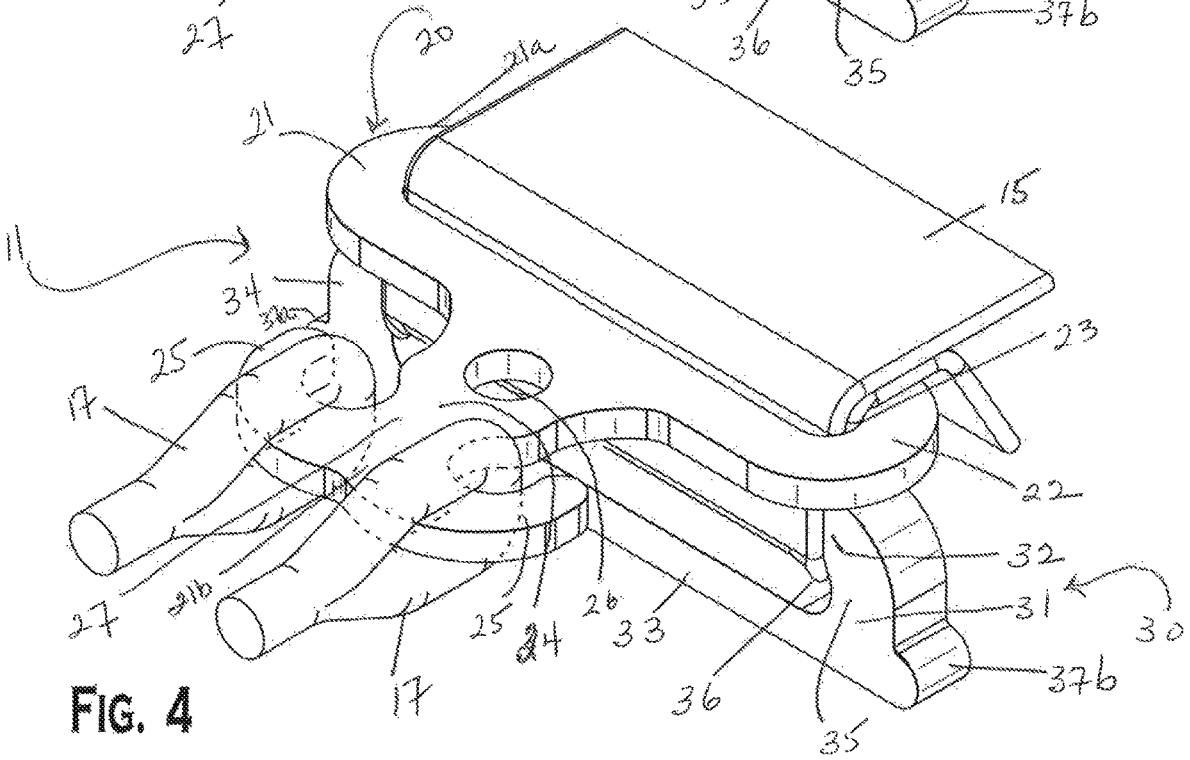
FIG. 4

TENSION BUCKLE SYSTEM AND TWO-PART TENSION BUCKLE DEVICE

FIELD OF THE INVENTION

The invention relates to a tension buckle system and, more particularly, to a tension buckle system connecting two points to support a load.

BACKGROUND

Tools for securing strapping between two objects or between two points of attachment are of interest in many applications. In particular, there is a need for a tool to quickly set, maintain, adjust, or release tension in strapping and cordage used for camping equipment, such as for backpacks, tarpaulins (tarps), hammocks, flys, tents and similar shelters, or other structures.

While tools to set, maintain, adjust, and release tension in strapping and lines are known, these known tools are generally bulky, weighty, and cumbersome, and often include various catchs, eyes, cleats, grips, pulleys, and the like, which require multiple knots to function. Cleats and grips can abrade or damage strapping and other tie materials used to suspend loads.

SUMMARY

In light of the shortcomings of the prior art and to solve a long felt need, the present invention was made in view of the above-mentioned issues and is directed toward a tension buckle system used to support and maintain tension with hammocks and other loads.

A tension buckle is provided and includes a slider body and a toggle body. The slider body includes a head with a slider strap receiving passageway extending there through from lateral sides thereof and positioned along a proximal end thereof, and a distal end having a neck positioned opposite the proximal end and tie section extending from the neck. The toggle body includes a top bar, a bottom bar positioned substantially parallel to the top bar, a first joining element connecting a first end of the top bar and a first end of the bottom bar, and a second joining element connecting a second end of the top bar and a second end of the bottom bar to provide a toggle strap receiving passageway extending though the toggle body from lateral sides thereof and positioned offset from the slider strap receiving passageway.

BRIEF DESCRIPTION OF THE DRAWINGS

The invention will now be described by way of example with reference to the accompanying figures, wherein like reference numerals designate like structural elements, and in which:

FIG. 3 is another perspective view of the tension buckle system of FIG. 2;

FIG. 4 is yet another perspective view of the tension buckle system of FIG. 2;

FIG. 5 is a top view of the tension buckle system of FIG. 2, showing a line threaded there-through;

FIG. 8 is another cross section of the tension buckle system along a center axis thereof, showing a strap positioned there through;

DETAILED DESCRIPTION OF THE DRAWINGS

Embodiments of the invention will now be described in greater detail with reference to the accompanying drawings.

Figure 1:
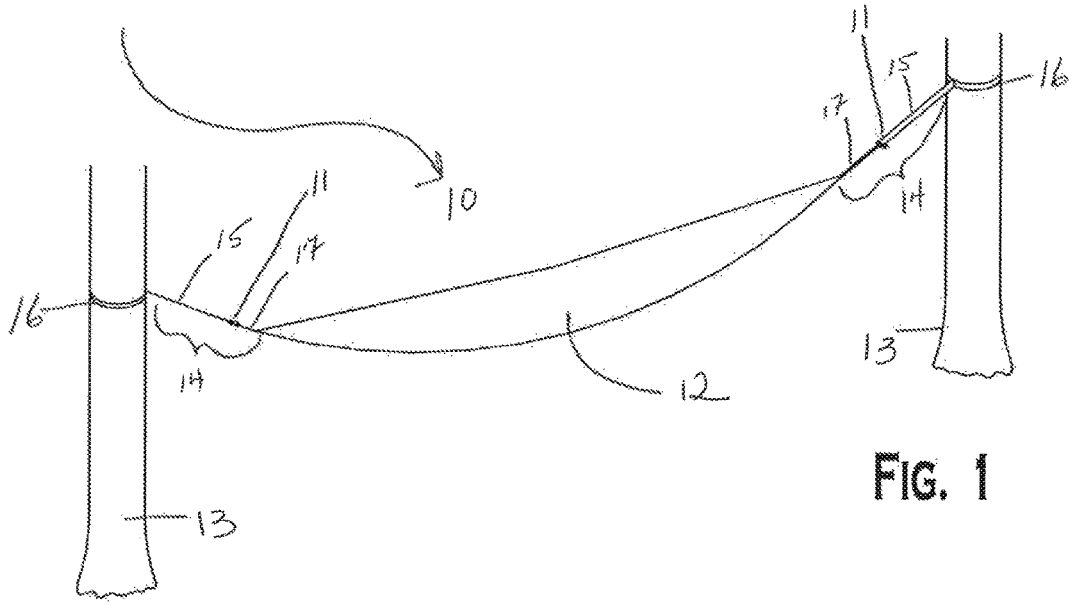
FIG. 1 shows a perspective view of a tension buckle system according to the invention, shown to suspend a known hammock.
Figure 2:
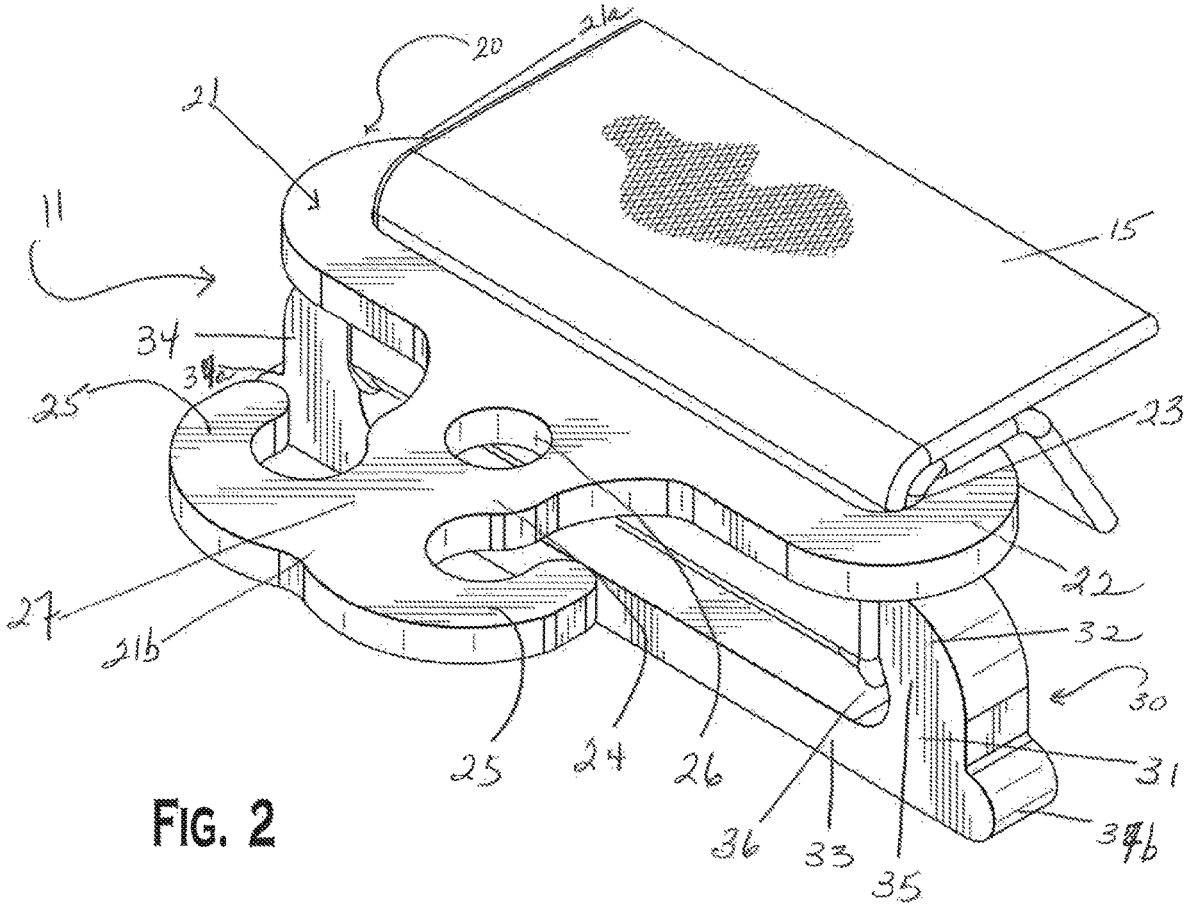
FIG. 2 is a perspective view of a tension buckle system according to the invention.

With reference to FIG. 1, a tension buckle system according to an exemplary embodiment is shown and is generally referred to by reference numeral 10.

As shown in FIGS. 1-17, the tension buckle system 10 generally includes a two-part tension buckle 11 having a slider 20 and a toggle 30.

As shown in FIG. 1, when assembled and installed, the tension buckle system 10 holds a hammock 12 or other load in a desired position between first and second supports 13 using tie materials 14 (including strap 15 and a line 17) and a plurality of two-part tension buckles 11.

FIGS. 2-17 feature elements of the two-part tension buckle system 10 useful, in all embodiments, for securing a weight or load with tie materials 14, more particularly referred to as a strap 15, a line 17, or similar securing materials.

As shown in FIGS. 2-13, the slider 20 in the shown embodiments is a shaped article having a rectangular cross section and two major planar surfaces positioned opposite and generally parallel to one another. The slider 20 includes a slider body 21, a proximal head 22, including a strap-receiving passageway 23, a distal neck 24 including at least one tie section 27. The at least one tie section 27 may more particularly be a catched projection 25, line-receiving passageway 26, or both. The embodiments illustrated herein show the invention with both a catched projection 25 (having two catchs) and line-receiving passageway 26.

The head 22 is located at a proximal end 21*a* of the slider body 21. The head 22 includes a strap receiving passageway 23, an elongated, oval-shaped opening extending through the body 21.

The body 21 extends from the head 22 to the catched projection 25 at a distal end 21*b*. Intermediate to the head 22 and the catched projection 25 is the neck 24. Within the neck 24 is located a line-receiving passageway 26, a cylindrically-shaped opening extending through the slider body 21 on the central axis. As used herein, a "cylindrically-shaped opening" describes line-receiving passageway 26: a hollow tube with straight sides and cross sections that are circular. As used herein, an "elongated, oval-shaped opening" describes strap receiving passageway 23: a hollow tube with straight sides and cross sections that are shaped like a flattened circle that is longer than it is wide.

As shown in FIGS. 2-9 and 14-17, the toggle 30 in the shown embodiments is a shaped article having a rectangular cross section and two major planar surfaces positioned opposite and generally parallel to one another.

The toggle 30 includes a body 31, a top bar 32, a bottom bar 33, a first joining element 34, a second joining element 35, and an elongated, oval-shaped opening 36. The first and second joining elements 34, 35 are positioned joined to the end of and generally perpendicular to the top bar 32 and bottom bar 33. A first grip projection 37*a* is located at the intersection of the first joining element 34 with a first end of bottom bar 33 and a second grip projection 37*b* is located at the intersection of the second joining element 35 with a second end of bottom bar 33. As used herein, an "elongated, oval-shaped opening" describes the strap receiving passageway 36: a hollow tube with straight sides and cross sections that are shaped like a flattened circle that is longer than it is wide. In the shown embodiment, the first and second joining elements 34, 35 are U-shaped. However, one skilled in the art would appreciate that other design are possible without departing from the spirit of the invention.

The two-part tension buckle 11 is designed with the toggle 30 wider in its outside dimensions than the elongated width of the slider strap receiving passageway 23. The two-part tension buckle 11 is sized to receive a first end of a strap 15 threaded in a first direction through the strap receiving passageway 23 of the slider body 21, threaded through the strap receiving passageway 36 of the toggle body 31, to loop around the top bar 32 of the toggle body 31, and returned in a second direction through the strap receiving passageway 23 of the slider body 21.

When the strap 15 is so arranged and the toggle 30 is positioned adjacent to the slider 20 with the top bar 32 within a loop 40 of strap 15, the strap 15 is prevented from slipping through the slider strap receiving passageway 23. This is termed the "locked position" for the strap 15.

In the shown embodiments, the two-part tension buckle 11 is made from a rigid material, such as titanium, aluminum, steel, or plastic. Preferably, the slider 20 and the toggle 30 are made from titanium, aluminum. In the shown embodiment, the slider 20 and the toggle 30 are each a solid monolithic piece of material. However, one skilled in the art would appreciate that the slider 20 and the toggle 30 each may be prepared from a variety of structural materials including an alloy of metals, a polymer, a composite, or other compatible and suitable material known in the art. The choice of the solid structural material is influenced by the material's weight, durability, cost, and the load it will be supporting. Further, one skilled in the art would appreciate that the slider 20 and toggle 30 may be hollow.

The two-part tension buckle 11 is manufactured through machining, but could be manufactured using casting, stamping, or through another method known to one of skill in the art, and consistent with the chosen material to achieve the desired strength of the two-part tension buckle for its intended use. For instance, the components of two-part tension buckle 11 made of polymer could be manufactured using injection molding.

In the shown embodiment, edges 43 of the components of the two-part tension buckle 11 are preferably beveled or softened from a 90° angle along a perimeter thereof and, more particularly, at strap receiving passageways 24 and 36 and at line-receiving passageway 26 in order to avoid wear or abrasion on strap 15 or line 17 passing over the beveled edge 43.

In an exemplary embodiment, the two-part tension buckle 11 is sized for straps and for 3/32" to 1/8" static (non-stretch) cord as is typically used in camping equipment, but is not limited for use with any specifically sized support material, such as lines or straps. Furthermore, it is expected that the two-part tension buckle 11 may be scaled larger or smaller to accept tie materials 14 of different diameters or width for use in different applications. The operation of such relatively larger or smaller two-part tension buckle 11 will be the same regardless of the specific application.

Referring back to FIG. 1, use of the tension buckle system 10 will be described. The two-part tension buckle 11 is generally used to maintain tension of tie materials 14 that restrain a hammock 12 or other weight or load in a substantially linear orientation relative to a longitudinal axis between two supports 13.

As shown in FIG. 1, to use the invention, a site is selected that will allow for the tension buckle system 10 including a hammock 12 to be positioned between supports 13. The selected site offers a spatial arrangement that provides a substantially unobstructed space in which to set the hammock 12 to a desired length and tension and at a desired height above the ground. In the illustrated embodiment of FIG. 1, the supports 13 are living trees. It is preferable that living trees are at least 8 inches in diameter or adjudged to be sufficiently strong to bear the weight of the load to be suspended. Alternative structures or points from which to suspend the strap fastener system 10 include structurally strong living and dead tree branches and trunks, boulders, rock faces, flag or light poles, walls, rafters, railings, beams, and other points that can support a weight of several hundred pounds without structural failure. A support 13 may be vertical to the ground, such as a tree, post, or similar element. Alternatively, a support 13 may be horizontal relative to the ground, such as a branch or a stationary railing. Also, a support 13 may include hardware attached to a vertical or horizontal support.

As shown in FIG. 1, the hammock 12 is positioned between first and second supports 13 using straps 15, lines 17, and two-part tension buckles 11.

Figure 5:
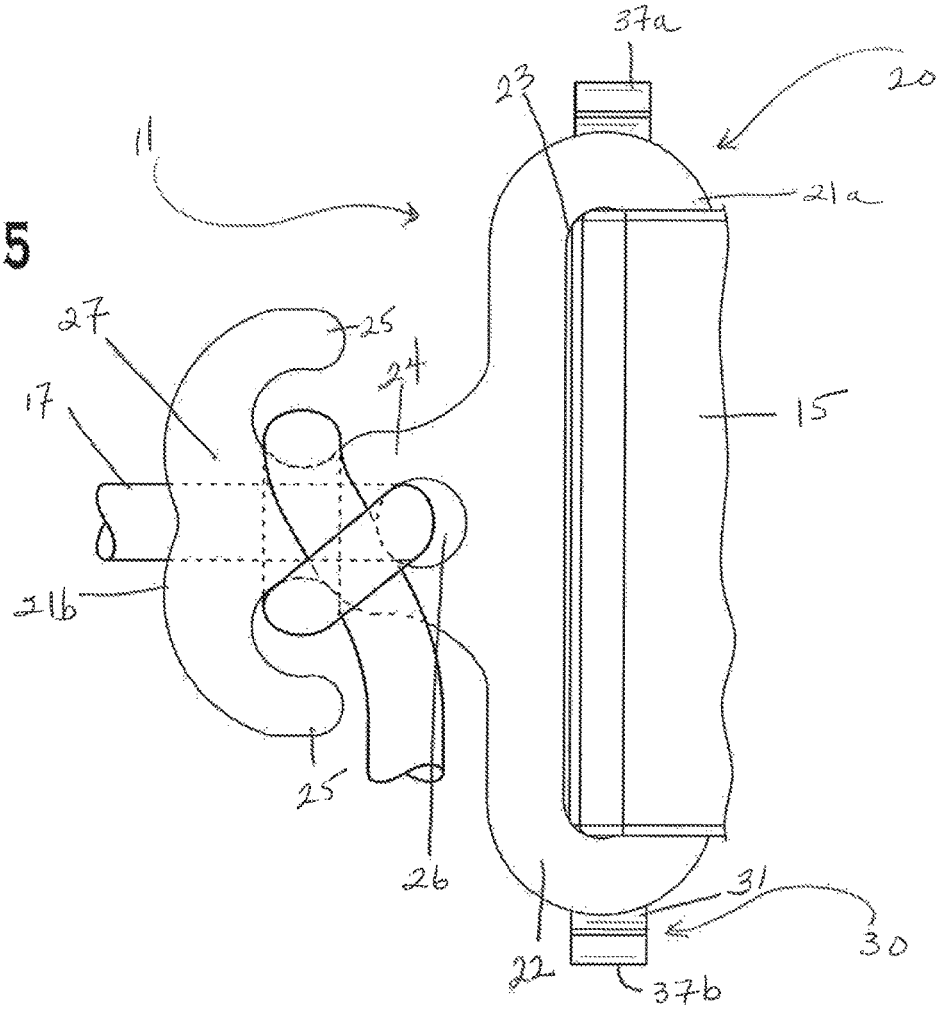
Figure 6:
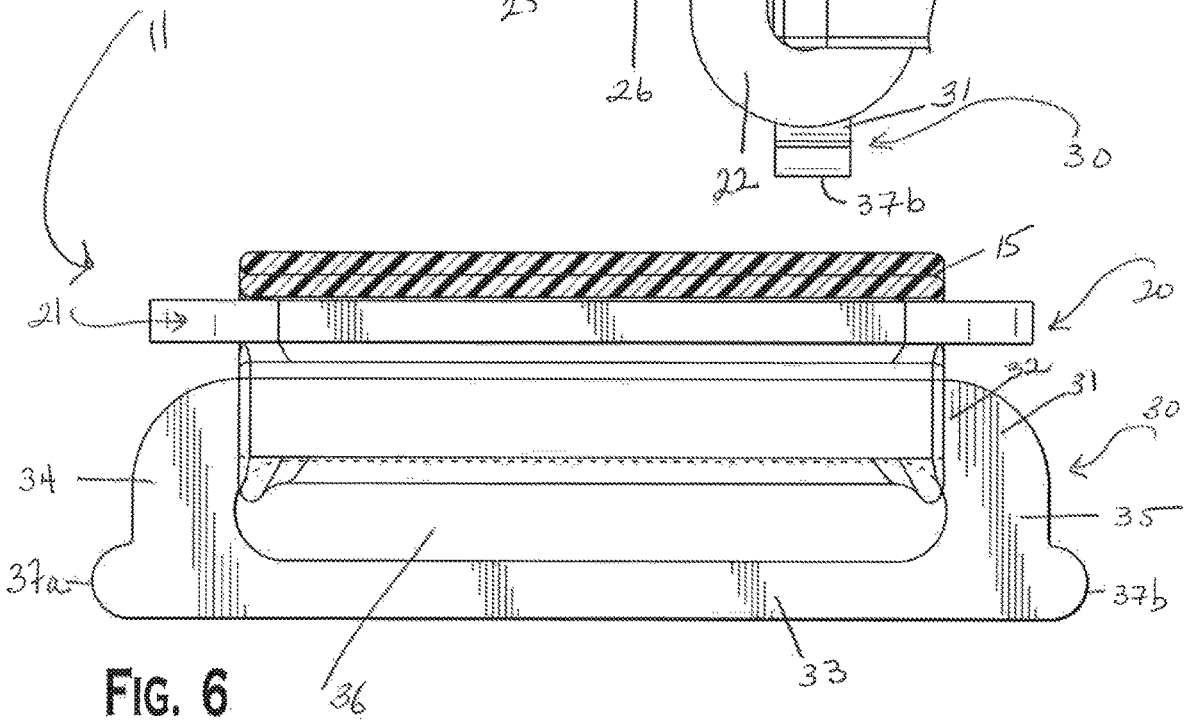
FIG. 6 is a rear view of the tension buckle system of FIG. 2.
Figure 7:
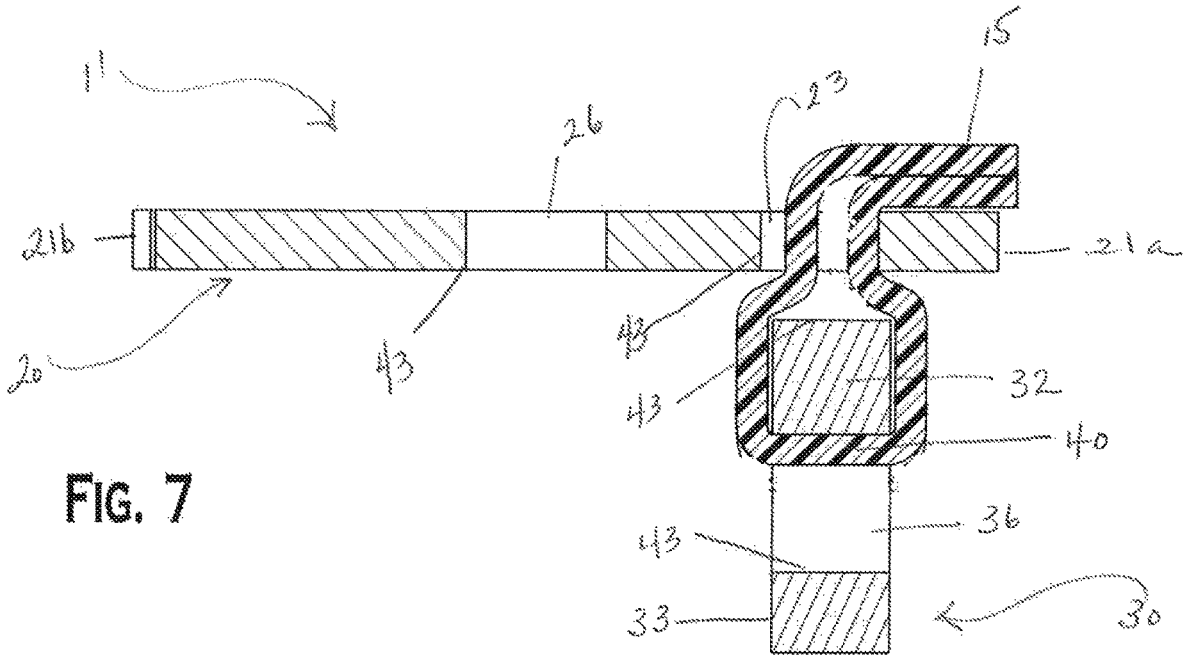
FIG. 7 is a cross section of the tension buckle system along a center axis of FIG. 2.
Figure 8:
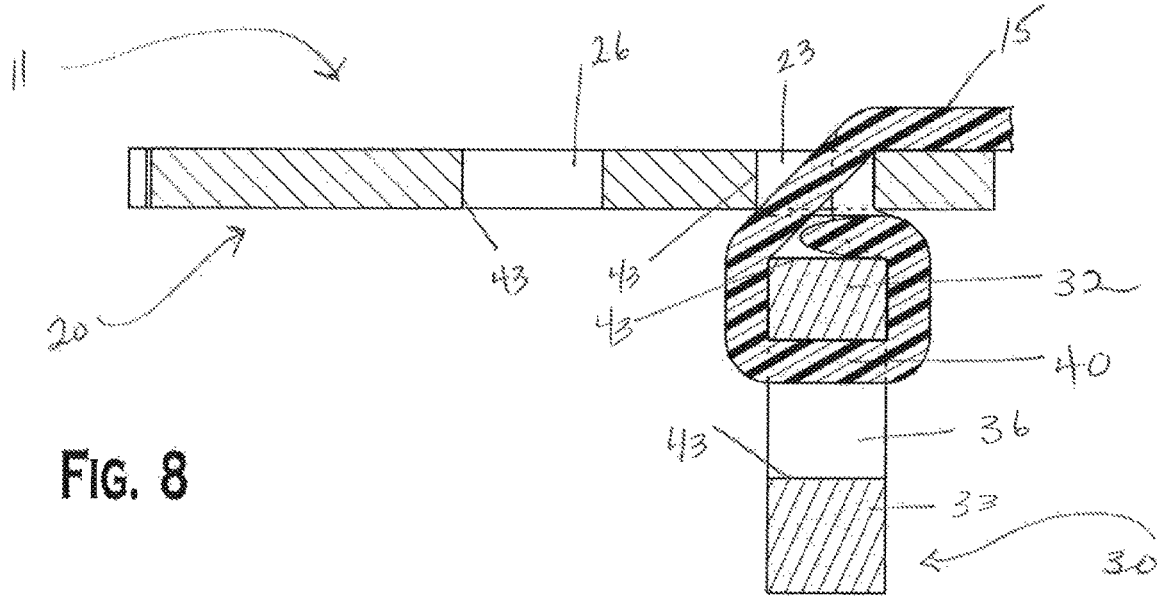
Figure 9:
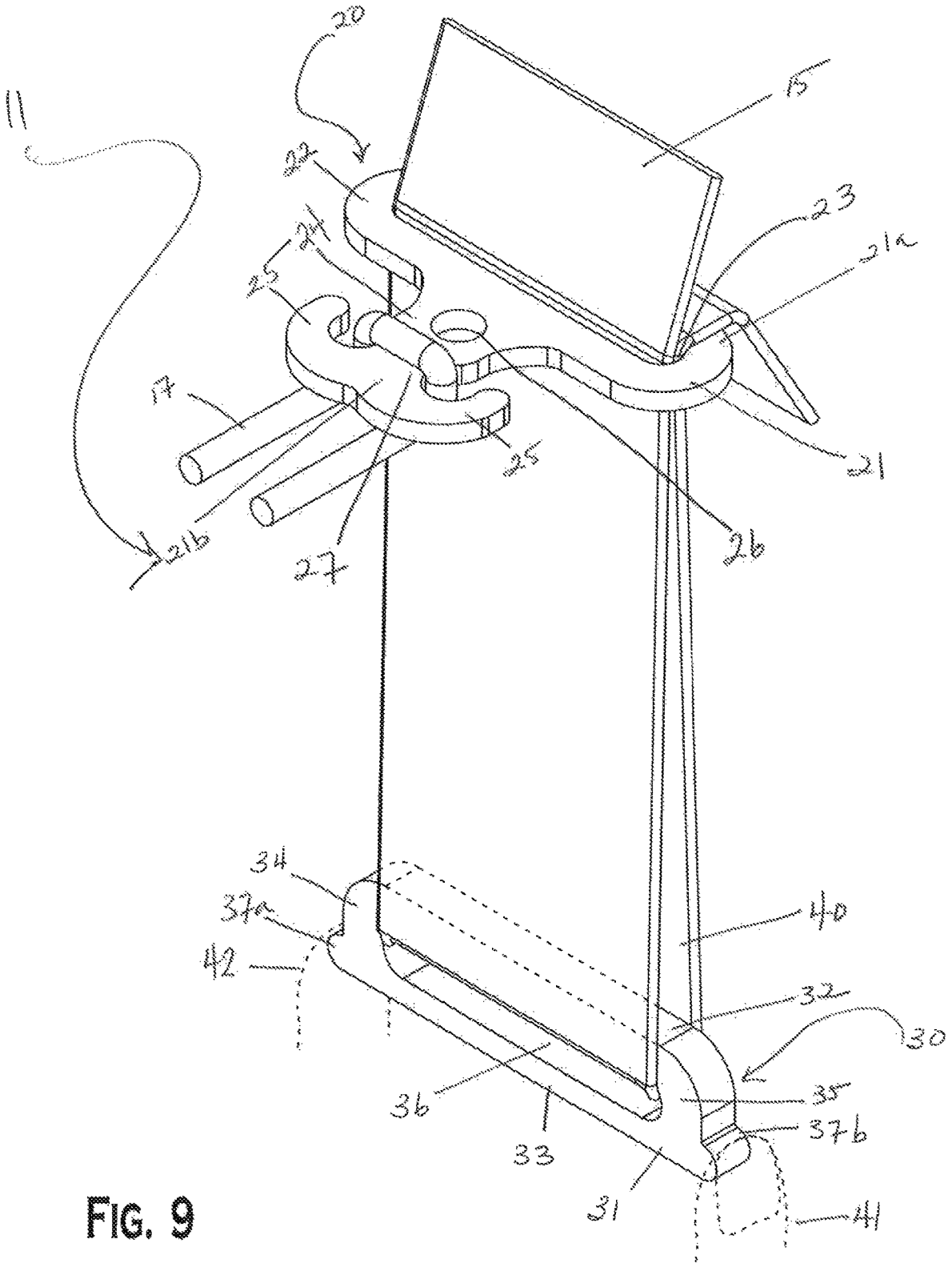
FIG. 9 is an exploded perspective view of the tension buckle system.
Figure 10:
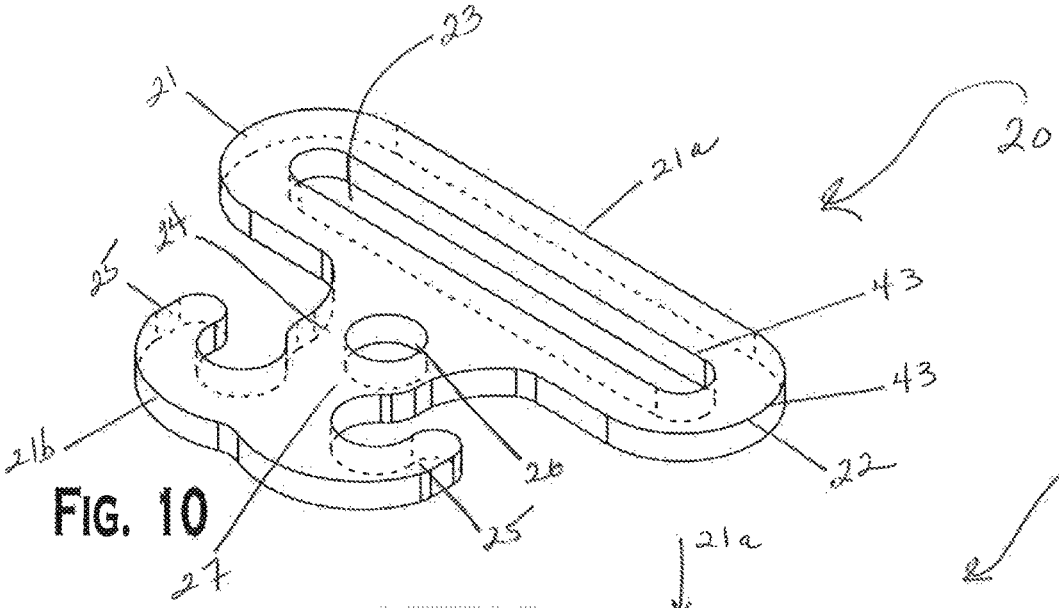
FIG. 10 is a perspective view of a slider body of the tension buckle system according to the invention.
Figure 11:
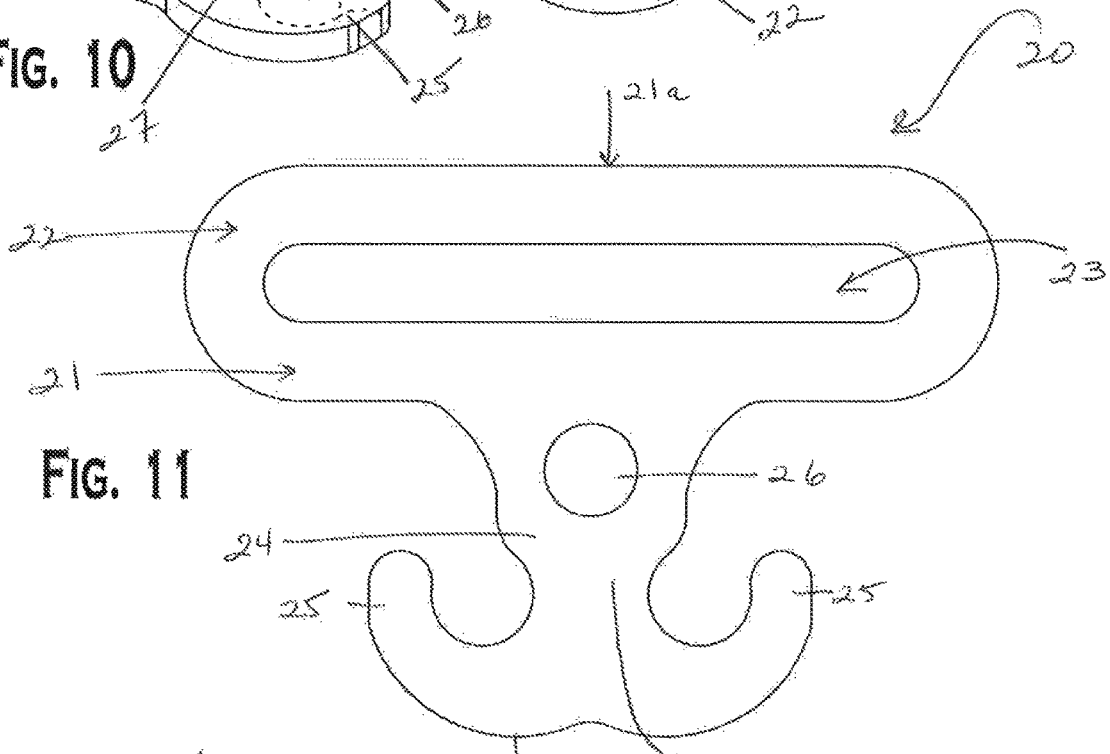
FIG. 11 is a top plan view of the slider body of FIG. 10.
Figure 12:
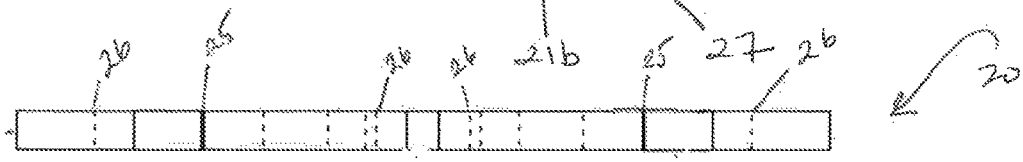
FIG. 12 is a an elevation view of the distal end of the slider body of FIG. 10.
Figure 13:
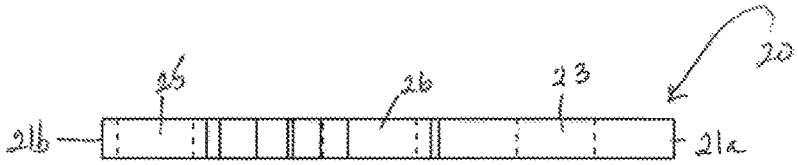
FIG. 13 is a side view of the slider body of FIG. 10.
Figure 14:
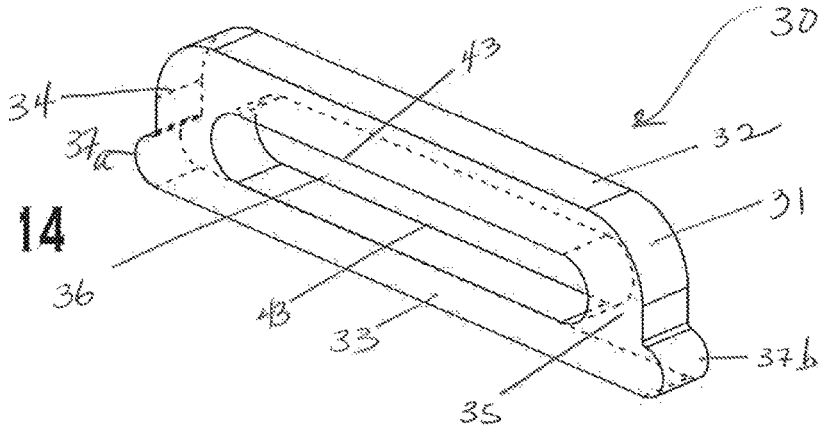
FIG. 14 is a perspective side view of a toggle body of the tension buckle system according to the invention.
Figure 15:
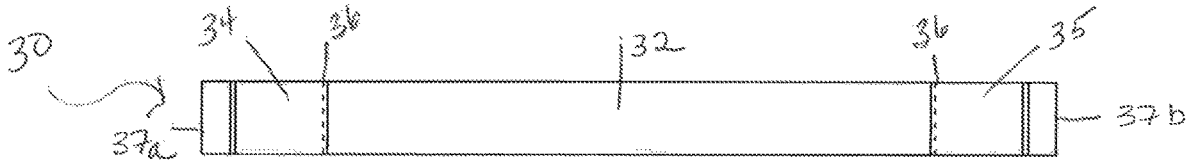
FIG. 15 is a top plan view of the toggle body of FIG. 14.
Figure 16:
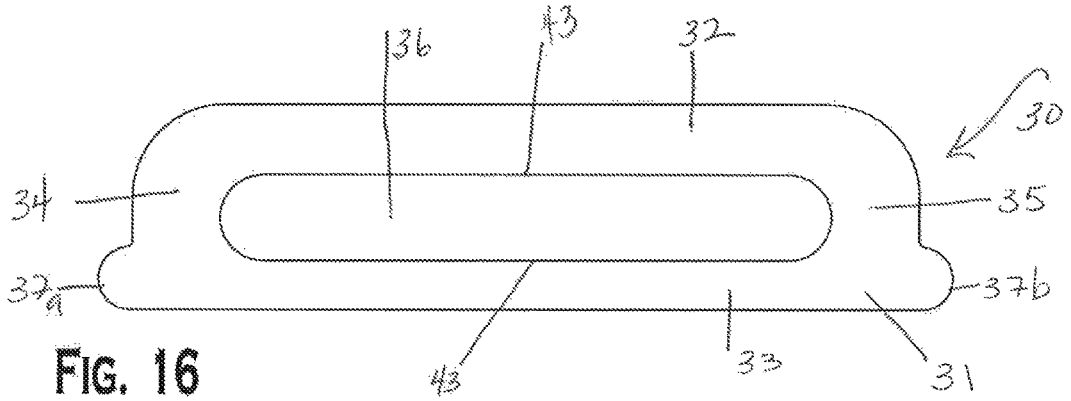
FIG. 16 is a front elevation view of the toggle body of FIG. 14.
Figure 17:
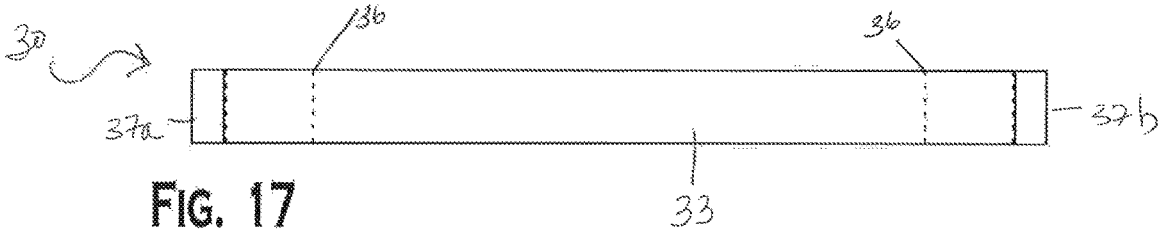
FIG. 17 is a bottom plan of the toggle body of FIG. 14.

Line 17 is secured to hammock 12 or other load by various methods known to those of skill in the art. The particular connection of line 17 is determined by the configuration of the specific hammock or load to be suspended. The portion of hammock 12 to which line 17 will be attached (not shown in detail) may be in the form of a bridge structure or a gathered end. One skilled in the art would appreciate that the shape, size, and material of the hammock 12 can be modified and designed for a particular use. Line 17 is coupled to slider 20 by being threaded through line-receiving passageway 26 (as shown in FIG. 5) or by being secured about catchs 25 (as shown in FIGS. 3-4, and 9). A slider body 21 having a single catch is a further (unillustrated) embodiment of the invention.

A strap 15 is secured at one end about support 13 by means of knots or, preferably, a looped end formed in a first end of the strap 15. Such looped webbing straps 16 are known as "tree huggers" or "tree straps" and help reduce abrasion or damage to the tree surface from the suspended weight or load. The lengths of strap 15 are sized to adequately encircle a tree and support the hammock 12 or other load. Additional accessory materials (i.e., tubing, padding) may also be used to maintain the strap 15 in position and to distribute the pressure and load placed by the hammock 12 on the support 13.

As shown in FIGS. 2-9, a second end of strap 15 is threaded sequentially through strap receiving passageway 23 of the slider 20, through the strap receiving passageway 36 of the toggle 30, looped around the toggle top bar 32, and back through the strap receiving passageway 23 in a second direction. This configuration forms loop 40 in strap 15, most clearly illustrated in FIG. 9.

Once the toggle 30 and slider 20 components of the two-part tension buckle 11 have been secured to the strap 15 and line 17 as set out above, the overall length of the span between the two supports 13 is set to the desired length and tension to use the hammock 12.

Now with reference to FIG. 9, the grip projections 37*a*, 37*b* on opposing sides of the bottom bar 32 of the toggle 30 are gripped, respectively, with thumb 41 and a finger 42 so that a force can be exerted in a direction to elongate the loop 40 of strap 15 to a desired distance between the toggle 30 and the slider 20. Alternatively, a tool such as a set of pliers may be used to grip the grip projections 37*a*, 37*b*. The grip projections 37*a* and 37*b* are illustrated to be smoothly rounded. Additional embodiments of the invention include grip projections that have ribs, gridding, or other texturing (not illustrated) that improve the gripping ability of fingers or plier-like tools.

To set the desired tension and distance between the two-part tension buckle 11 and the supports 13, strap 15 is pulled with sufficient force to bring the toggle 30 and the slider 20 into a locked position as shown in FIGS. 2-8. When toggle 30 is positioned immediately adjacent to the slider 20 with the toggle head 31 within loop 40 of strap 15 and perpendicular to the slider strap receiving passageway 23, strap 15 is prevented from slipping through the slider strap receiving passageway 23. In this "locked" position, the weight is adjustably fixed in placed.

The strap 15 and line 17 are selected to possess characteristics of strength and durability suitable for the tension and weight to be secured. Choices of material suitable to a particular application are a flexible strap, webbing, or ribbon (hereinafter referred to generally as "strap") or a flexible, linear element such as a cord, cable, line, rope, string, or twine (hereinafter referred to generally as "line"). The strap 15 has a substantially rectangular cross-section; its width is substantially greater than its height and its overall dimensions and material properties are suitable for the weight to be secured and conditions of use. The line 17 has a substantially circular cross-section and its diameter, length, and material properties are selected to be suitable for the weight to be secured and conditions of use.

The strap 15 and the line 17 are made of various materials including woven, braided, or twisted nylon or other plastic polymer, natural fibers, such as hemp or silk, and other such material used by those of skill in the art to secure weights or loads. Preferably, tie materials 14 selected to use with the tension buckle system 11 are characterized by low stretch, abrasion resistance, light resistance, high strength, and highly durability and are light in weight.

Preferably, the tie materials 14 selected to use with the two-part tension buckle 11 are made of an ultra-high molecular weight polyethylene (UHMwPE) fiber. This type of fiber is alternatively referred to as high-modulus polyethylene (HMPE) and high-performance polyethylene (HPPE). This type of line features light weight, high strength, high durability, and has a surface texture conducive to maintaining a tension suitable for securing a hammock or other load. One commercially available fiber suitable for use with the two-part tensioning device is Dyneema®. However, such high performance strap or line is not required as the two-part tension buckle 11 may be used with any material that is appropriate for the weight to be secured and the particular embodiment of the invention. An alternative choice of fiber for tie materials 14 is a lightweight nylon kernmantle rope, also referred to as parachute cord. A further alternative choice of fiber can be a monofilament line. The tie materials 14 are sized to meet the use and dimensions of the two-part tensioning device 11. In an exemplary embodiment, the two-part tensioning device is sized for 3/32" to 1/8" static (non-stretch) line, but is not limited for use with any specific sized tie material. In applications of the two-part tensioning device 11, a user should not attempt to secure a load heavier than what the chosen tie material 14 can support.

A kit comprising a plurality of two-part tension buckles 11, straps 15, and lines 17 is one embodiment of the invention. One embodiment of the kit includes two-part tension buckles 11 pre-sewn onto lengths (for example, 8 and 15 feet) of polyester webbing straps. Various types of lines 17 (i.e., continuous loops, shock cords) may be included in a kit.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A tension buckle comprising a slider body having:

a head with a slider strap receiving passageway extending there through from lateral sides thereof and positioned along a proximal end thereof;

a distal end having a neck positioned opposite the proximal end and a tie section extending from the neck; and a toggle body having:

a top bar;

a bottom bar positioned substantially parallel to the top bar;

a first joining element connecting a first end of the top bar and a first end of the bottom bar; and a second joining element connecting a second end of the top bar and a second end of the bottom bar to provide a toggle strap receiving passageway extending though the toggle body from lateral sides thereof and positioned offset from the slider strap receiving passageway and a strap positioned through the slider strap receiving passageway, then through the toggle strap receiving passageway, wrapped around the top bar, and then returned through the slider strap receiving passageway.

2. The tension buckle of claim 1, wherein the tie section includes a line-receiving passageway extending though the slider body from the lateral sides thereof.

3. The tension buckle of claim 1, wherein the tie section further includes a projection having a catch extending toward the proximal end of the slider body.

4. The tension buckle of claim 3, wherein the catch is hook that is curved toward the proximal end of the slider body.

5. The tension buckle of claim 1, wherein the tie section includes a projection having two catches symmetrically disposed and facing in opposite directions from a central longitudinal axis of the slider body in a common plane and opening toward the proximal end of the slider body.

6. The tension buckle of claim 1, wherein the toggle body further includes a first grip projection located at an intersection of the first joining element with the first end of the bottom bar and a second grip projection located at an intersection of the second joining element with the second end of the bottom bar.

7. The tension buckle of claim 1, wherein the slider body is titanium.

8. The tension buckle of claim 1, wherein the slider body has beveled edges.

9. The tension buckle of claim 8, wherein the toggle body has beveled edges.

10. A tension buckle comprising a slider body having:

a head with a slider strap receiving passageway extending there through from lateral sides thereof and positioned along a proximal end thereof; and a distal end having a neck positioned opposite the proximal end and a tie section extending from the neck, the tie section having a line-receiving passageway extending though the slider body from the lateral sides thereof;

a toggle body having:

a top bar;

a bottom bar positioned substantially parallel to the top bar;

a first joining element connecting a first end of the top bar and a first end of the bottom bar; and a second joining element connecting a second end of the top bar and a second end of the bottom bar to provide a toggle strap receiving passageway extending though the toggle body from lateral sides thereof and positioned offset from the slider strap receiving passageway, and a strap positionable through the slider strap receiving passageway, then through the toggle strap receiving passageway, wrapped around the top bar, and then returned through the slider strap receiving passageway.

11. The tension buckle of claim 10, wherein the tie section further includes a projection having a catch extending toward the proximal end of the slider body.

12. The tension buckle of claim 11, wherein the catch is hook that is curved toward the proximal end of the slider body.

13. The tension buckle of claim 10, wherein the toggle body further includes a first grip projection located at an intersection of the first joining element with the first end of the bottom bar and a second grip projection located at an intersection of the second joining element with the second end of the bottom bar.

14. A tension buckle comprising a slider body having:

a head with a slider strap receiving passageway extending there through from lateral sides thereof and positioned along a proximal end thereof; and a distal end having a neck positioned opposite the proximal end and a tie section extending from the neck, the tie section having includes a projection having two catches symmetrically disposed and facing in opposite directions from a central longitudinal axis of the slider body along a common plane and opening toward the proximal end of the slider body; and a toggle body having:

a top bar;

a bottom bar positioned substantially parallel to the top bar;

a first joining element connecting a first end of the top bar and a first end of the bottom bar;

a second joining element connecting a second end of the top bar and a second end of the bottom bar to provide a toggle strap receiving passageway extending though the toggle body from lateral sides thereof and positioned offset from the slider strap receiving passageway;

wherein the tie section includes a line-receiving passageway extending though the slider body from the lateral sides thereof.

15. The tension buckle of claim 14, wherein the tie section further includes the projection having a catch extending toward the proximal end of the slider body.

16. The tension buckle of claim 15, wherein the catch is hook that is curved toward the proximal end of the slider body.

17. The tension buckle of claim 14, wherein the toggle body further includes a first grip projection located at an intersection of the first joining element with the first end of the bottom bar and a second grip projection located at an intersection of the second joining element with the second end of the bottom bar.

18. A tension buckle comprising a slider body having:

a head with a slider strap receiving passageway extending there through from lateral sides thereof and positioned along a proximal end thereof; and a distal end having a neck positioned opposite the proximal end and a tie section extending from the neck; and a toggle body having:

a top bar positioned on a major surface of the slider body and positioned to align with the slider strap receiving passageway;

a bottom bar positioned substantially parallel to the top bar;

a first joining element connecting a first end of the top bar and a first end of the bottom bar; and a second joining element connecting a second end of the top bar and a second end of the bottom bar to provide a toggle strap receiving passageway extending though the toggle body from lateral sides thereof and positioned offset from the slider strap receiving passageway.

19. The tension buckle of claim 18, wherein the toggle body further includes a first grip projection located at an intersection of the first joining element with the first end of the bottom bar and a second grip projection located at an intersection of the second joining element with the second end of the bottom bar.

20. The tension buckle of claim 18, wherein the tie section includes a line-receiving passageway extending though the slider body from the lateral sides thereof.

21. The tension buckle of claim 20, wherein the tie section further includes a projection having a catch extending toward the proximal end of the slider body.

22. The tension buckle of claim 21, wherein the catch is hook that is curved toward the proximal end of the slider body.

23. The tension buckle of claim 18, wherein a strap is positioned through the slider strap receiving passageway, then through the toggle strap receiving passageway, wrapped around the top bar, and then returned through the slider strap receiving passageway.

* * * * *